United States Patent [19]

Teron

[11] Patent Number: 4,589,330

[45] Date of Patent: May 20, 1986

[54] CEILING STRUCTURE

[75] Inventor: William Teron, Rockcliffe, Canada

[73] Assignee: Teron International Urban Corp. Ltd., Ottawa, Canada

[21] Appl. No.: 369,142

[22] Filed: Apr. 16, 1982

[30] Foreign Application Priority Data

Apr. 22, 1981 [GB] United Kingdom ..... 8112436

[51] Int. Cl.[4] ..... F24F 7/00; E04B 5/48

[52] U.S. Cl. ..... 98/31; 52/220; 98/40.1

[58] Field of Search ..... 98/40 D, 40 DL, 31, 98/40.05, 40.07, 40.1; 52/220, 262, 252, 730, 262; 256/17, 14; 165/53, 56; 138/105, 179, 149

[56] References Cited

U.S. PATENT DOCUMENTS

| | | | |
|---|---|---|---|
| 2,564,334 | 8/1951 | Kennedy | 98/40 DL |
| 2,970,676 | 2/1961 | Maciunas | 52/262 X |
| 3,283,456 | 11/1966 | Carlton | 52/220 X |
| 3,759,159 | 9/1973 | Rachlin et al. | 98/40 C |
| 3,841,206 | 10/1974 | Meckler | 98/31 X |
| 4,018,160 | 4/1977 | Cunningham et al. | 98/40 C X |

FOREIGN PATENT DOCUMENTS

| | | | |
|---|---|---|---|
| 2324224 | 5/1973 | Fed. Rep. of Germany | 52/220 |

*Primary Examiner*—William E. Wayner

*Attorney, Agent, or Firm*—Larson and Taylor

[57] ABSTRACT

A combined ceiling, air distribution system, mechanical chasse and structural roof member for a building is formed by a plurality of parallel inverted U-shaped structural modules 15 which are supported in a common horizontal plane. The flanges 17 of adjacent modules are spaced apart and define the side walls of a duct 21, top and bottom walls 22, 24 for the duct also being supported between the adjacent modules. The duct may be of any suitable dimensions, and in particular may be sufficiently large as to handle air flow requirements for the heating, ventilating or air conditioning system for the building. The duct may also accommodate other services such as electrical, plumbing, compressed air, etc. This arrangement dispenses with the need for a suspended ceiling which has conventionally been provided beneath the duct work and service lines attached to the ceiling of a building.

15 Claims, 7 Drawing Figures

CEILING STRUCTURE

FIELD OF THE INVENTION

This invention relates to a new or improved combined ceiling, air distribution system, mechanical chasse and structural roof members for buildings, useful primarily, although not exclusively, in commercial, industrial and institutional applications.

DESCRIPTION OF THE PRIOR ART

At least in commercial buildings it is common practice to provide a suspended ceiling spaced below the structural ceiling of the building. The space between the suspended ceiling and the structural ceiling accommodates typical building services such as sheet metal duct work for heating, ventilation and air conditioning, electric and telephone service lines, etc. The suspended ceiling may take any of various well known forms, and usually incorporates recessed lighting fixtures and air exchange diffusers. Although previously considered necessary to provide a ceiling having an aesthetically pleasing appearance, suspended ceilings are disadvantageous since they are expensive to provide and to install. Furthermore, they reduce the headroom available in a building. In other words for a given effective ceiling height, the height between the floor and the structual ceiling must be increased to accommodate the space enclosed above the suspended ceiling, increasing the total height and volume of the building, and this clearly will add to the construction cost.

SUMMARY OF THE INVENTION

According to a preferred embodiment, the invention is a ceiling structure for a building comprising a plurality of elongated inverted U-shaped beams, each formed of a top panel and a pair of legs joined along a smooth radius and defining a wide and elongated arch, the arch being shaped and finished to be pleasing to the eye. The beams are spaced parallel to each other a distance apart substantially less than the transversed dimension of the arch. Air ducting and lighting structures are contained within the space between the beams. Upper and lower walls for the space define an enclosure between the legs of adjacent beams for containing the air ducting and/or lighting structures whereby air and/or lighting structures are provided for the building between the beams yet the major ceiling height and ceiling surfaces are defined by the arches.

The enclosure may form an air flow duct in the air exchange system for the building, being suitably connected to a network of collector and distribution channels. The enclosure can be vertically divided by an elongated intermediate panel to form an upper air flow duct and a lower utility duct. Air exchange between the air flow duct and the building space may be effected by any suitable means, such as diffusers positioned in the lower wall surface of the enclosure. The duct may also accommodate other building service structures such as telephone, electrical, plumbing, compressed air, etc. Conveniently, the lower wall of the duct is slightly offset upwardly between the flanges to accommodate lighting fixtures carried beneath this lower wall and extending between the lower ends of the legs. Thus, the ceiling of the building space is provided directly by the surfaces defining the underside of the top panel, and the confronting inner sides of the legs (which form the arches), together with the lighting fixtures, filler panels or the like attached to the underside of the lower wall surface of the enclosure. The beams are conveniently produced as reinforced cast concrete monolithic structures, and accordingly can be fabricated with very smooth surfaces requiring no more than painting or the like to provide a finished ceiling surface.

The structure described therefore dispenses with the need for a suspended ceiling and provides a convenient means for accommodating the various building services, while providing at comparatively low cost a finished ceiling surface of acceptable appearance, and an overlying roof, or floor of an upper storey.

The upper wall of the duct may be provided for example by a concrete filler slab carried in steps formed in the sides of the adjacent modules, the upper surface of the slab being flush with the upper surfaces of the adjacent module panels or by any other form of insert. These surfaces may form part of the roof structure, or in a multi-storey building may form a floor for a higher storey.

BRIEF DESCRIPTION OF THE DRAWINGS

The invention will further be described, by way of example only, with reference to the accompanying drawings wherein.

DESCRIPTION OF THE PREFERRED EMBODIMENT

Figure 1:
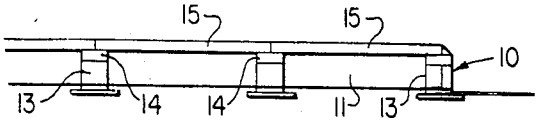
FIG. 1 is a somewhat schematic side elevation of a single storey building incorporating a ceiling structure in accordance with the invention.
Figure 2:
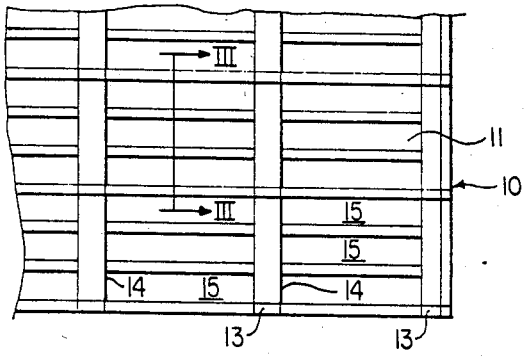
FIG. 2 is a corresponding plan view.

The building 10 schematically shown in FIGS. 1 and 2 is a single storey structure defining a series of bays 11 laid out in a rectangular grid network. The structure may be best understood by reference to FIG. 7 which shows a single bay of the building. The building is fabricated from reinforced concrete components and includes vertical hollow columns 13 arranged one at each corner of a bay at suitable spacing, as shown, this being at center-to-center distances of 14 meters in the longitudinal direction and 9.2 meters in the transverse direction. The columns 13 support a series of horizontal transverse hollow beams 14, each of the interior columns of the building forming a support for the adjacent ends of two such beams 14.

Figure 7:
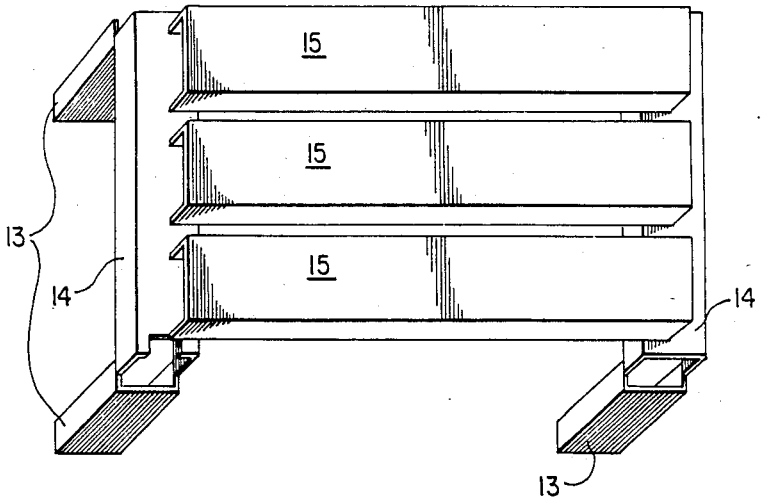
FIG. 7 is a schematic top perspective view of a bay of the building.

Above the beams 14 are arrayed a series of spaced parallel longitudinal beam or modules 15, the opposite ends of which are supported on the beams 14 as best seen in FIG. 7. Each module is of inverted U-shaped configuration and comprises a monolithic cast reinforced concrete structure formed by a top panel 16 from the opposite longitudinal edges of which project a pair of depending flanges 17. The modules 15 are formed as pre-cast concrete units and include suitable refinforcing means indicated at 18 and 19, to improve their structural strength. The under surface of the panel 16 and the contiguous surfaces of the flanges 17 may be finished to a high quality of smoothness in the casting process, these surfaces merging through a radiussed corner 20.

Figure 3:
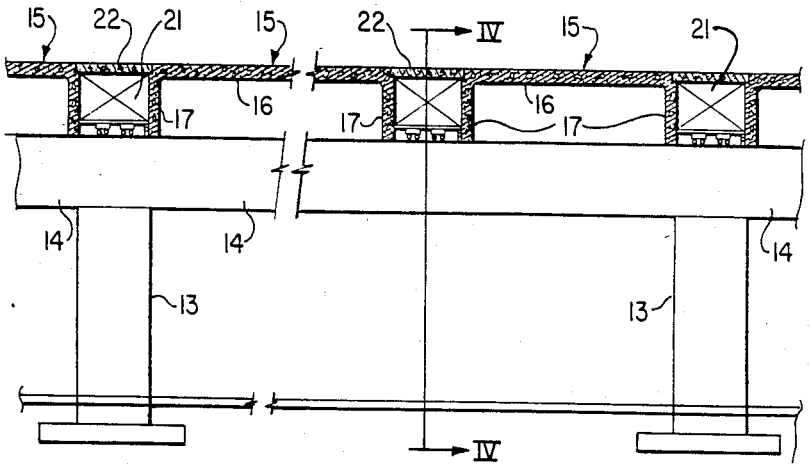
FIG. 3 is a sectional view taken on the line III—III in FIG. 2, and shown to an enlarged scale.
Figure 6:
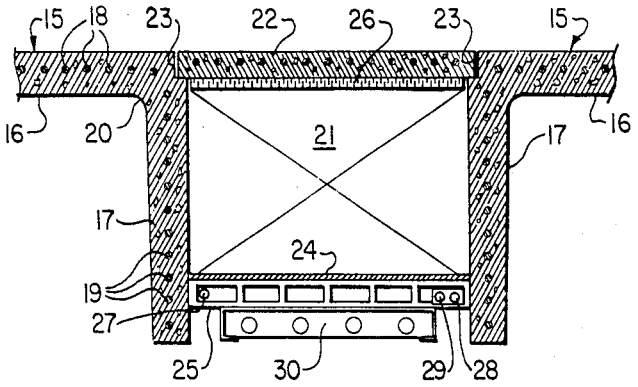
FIG. 6 is a sectional view to an enlarged scale taken on the line VI—VI in FIG. 5.

The modules 15 are arranged in spaced parallel relationship with the panels 15 thereof in a common plane such that the flanges 17 of adjacent modules are parallel and spaced apart a distance smaller than the transverse dimension of the arch. As shown in FIG. 6, these adjacent flanges define the side walls of a duct 21. The upper surface of the duct is provided by a concrete reinforced filler slab 22 which is supported between recessed seats 23 formed in the corners of the adjacent modules. The lower wall of the duct is provided by a closure panel 24 of non-structural material such as gyprock, supported between the flanges 17. At intervals along the flanges transverse open metal tie bars 25 are arranged, with their opposite ends secured to the flanges by suitable fastening means (not shown). The tie bars secure the closure panel 24 at a position offset upwardly from the lower ends of the flanges 27. As will be apparent, the duct 21 is defined on three sides by structural members of the building, namely the flanges 17 and the filler slab 22 and requires only the closure panel 24 for its completion. The duct can be of any suitable cross sectional area dependent upon the size and spacing of the flanges 27 and the vertical location of the panel 24. In the embodiment illustrated the modules 15 have a transverse width as seen in FIG. 3 of 2.4 meters and are spaced apart by a distance of 0.66 meters and the flanges 17 have a depth of 0.80 meters. The cross sectional area of the duct 21 being 0.66 meters by 0.5 meters.

A layer of insulating material 26 is provided on the wall of the duct defined by the slab 22. Similar insulating layers (not shown) may if desired also be provided on the walls defined by the flanges 17 and the closure panel 24.

The tie bars 25 provide a means for supporting and distributing other utility services throughout the building. For example, as shown in FIG. 6 the tie bar may support a compressed air conduit 27, an electric power conduit 28 and a telephone service conduit 29.

The tie bars 25 also support a series of fluoroescent lighting fixtures 30 which extend along the underside of the duct between the lower ends of the flanges 17, there being a continuous lighting diffuser or lighting lens 31 (see FIG. 5) filling the area between the lower ends of the flanges 17.

At suitable intervals along the ducts 21, air diffusers 32 are located to accommodate transfer of air between the ducts 21 and the building space beneath the ceiling. The ducts 21 are connected in a desired predetermined arrangement in the air handling system of the building, and may serve as supply or exhaust passages for the purposes of heating, ventilation or other air conditioning functions. It will be appreciated that by forming the air handling mechanical distribution system principally from the structural members of the ceiling, the need for the conventional independent sheet metal duct work, and the associated capital and installation costs thereof, is eliminated. Furthermore, the ducts 21 thus provided can be of relatively large cross sectional area so that for a given air exchange rate the air velocity in the system can be relatively low, and this accordngly reduces the power requirements of the air handling system, reducing dust disturbance and producing a cleaner environment.

Figure 4:
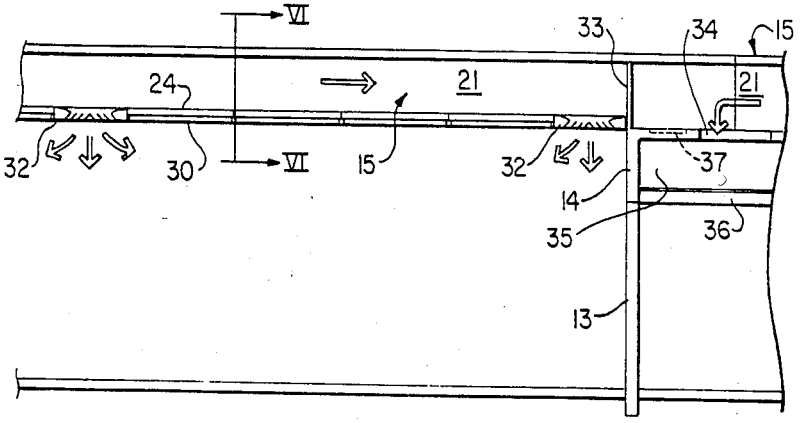
FIG. 4 is a sectional view taken on the line IV—IV in FIG. 3.

The U-shaped hollow beams 14 which support the ends of the modules 15 can be of substantially identical construction to the modules 15. Furthermore these beams 14 can be used to enclose air supply or return collector passages which communicate with the individual ducts 21. For example, the duct 21 as shown in the left hand part of FIG. 4 is an air supply duct, and as indicated by the arrows air from this duct is delivered into the building through the diffusers 32. FIG. 4 shows that above the left hand side of the beam 14, the duct 21 is closed off by an end panel 33. To the right of the end panel 23 the continuation of the duct 21 communicates with a duct 21 in an aligned contiguous module 15 and forms therewith an air return duct which communicates through an opening 34 with an air collector passageway 35. The passageway 35 is defined on three sides by the web and flanges of the beam 14, and on its lower side by a non-structural closure of the panel 36.

In similar manner, the air supply and collector passageways formed in the beams 14 may be connected through additional passageways (not shown) similarly formed in the hollow columns 13 to the air supply power plant (not shown).

The U-shaped hollow columns 13 may be of similar construction to the modules 15 and the beams 14, and the area enclosed thereby may be sealed on the remaining side by a non-structural panel (not shown). Alternatively, the area within a column 13 may be provided with access doors and may be used as a storage closet or a closet for housing building service utilities.

Figure 5:
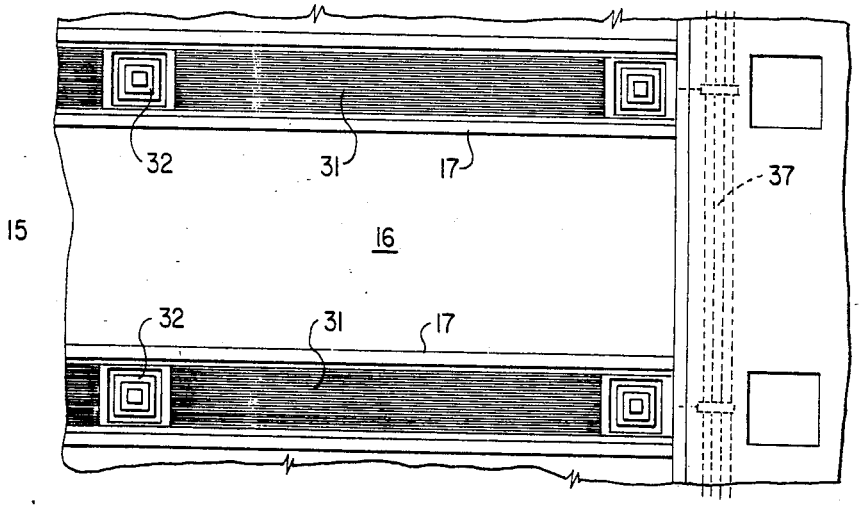
FIG. 5 is an underneath plan view of the arrangement shown in FIG. 4.

As with the air handling system, the other utilities provided in the ceiling structure may be extended from the ducts 21 into the beams 14, and if necessary into the columns 13. FIG. 5 illustrates at 37 such services extended along a beam 14.

The ceiling structure as described produces a number of advantages. The structure provides for efficiently designed bays which provide large clear spans. Costly duct work and suspended ceilings are eliminated. By utilizing ducts 21 of high volume cross section the air velocity requirements of the air handling system are reduced thus effecting savings in both the capital cost and operating cost of the air handling plant. The provision of electrical, communications and other services extending continuously along the underside of each of the ducts 21 and throughout the entire roof span provides great flexibility in extending these services downwardly into the building space at desired locations. It also allows great flexibility in the positioning and relocation of partition walls which may be used within the bays according to the space utilization requirements at any given time.

It will be evident that the system described represents a substantial simplification over existing building techniques using separate duct work and suspended ceilings, and accordingly that not only are the materials costs reduced, but there is also a significant increase in the efficiency or erection of the building both in terms of cost and of time required for completion. The relatively large size of the ducts facilitates access thereto and therefore maintenance, and also facilitates the installation of additional services. The construction technique and structure described achieves all of the above advantages using methods and materials which are largely conventional and require no special skills for their adoption.

What is claimed is:

1. A ceiling structure for a building comprising a plurality of elongated inverted U-shaped beams, each formed of a top panel and a pair of legs joined along a smooth radius and defining a wide and elongated arch, said arch being shaped and finished to be pleasing to the eye, the beams being spaced laterally parallel to each other a distance apart substantially less than the transverse dimension of said arch, air ducting and lighting structures being contained within the space between said beams, upper and lower walls for said space defining an enclosure between the legs of adjacent beams for containing the air ducting and/or lighting structures whereby air and/or lighting services are provided for said building between said beams yet the major ceiling height and ceiling surfaces for the building are defined by said arches, the building being divided into at least one room, and within said room all said arches are devoid of physical interruption whereby the ceiling of said room is substantially defined by one or more of said elongated arches with clear surfaces raised substantially from the lower extremity of said legs.

2. A ceiling structure for a building as defined in claims 1 in which the enclosure between said beams is comprised of at least one panel extending over the length of and being contained between the beams generally in a plane at the lower extremity of the legs of said adjacent beams.

3. A structure according to claim 1 in which the upper wall of said enclosure is comprised of a filler slab.

4. A structure according to claim 3 in which the beams and the filler slab are made of concrete, and the filler slab is received in a stepped seat in each of the adjacent beams so that the top surface of the slab is substantially flush with the top surfaces of the top panels of adjacent beams.

5. A structure according to claim 1 in which the beams constitute the structural portion of the building roof.

6. A structure according to claim 5 in which the top surfaces of the beams form a floor level for an upper storey of the building.

7. A structure according to claim 1 wherein said beams are arranged with their ends supported on hollow transverse beams, the interior of at least one such transverse beam being in communication with said enclosure.

8. A structure according to claim 7 in which each said transverse beam is elongated U-shape in form, comprising a structural unit formed by a horizontal top panel and depending legs, and also includes a non-structural wall extending horizontally between the lower ends of the legs.

9. A structure according to claim 8 in which said hollow transverse beams are supported on hollow vertical columns at least some of which have interiors in communication with said enclosure.

10. A structure according to claim 9 in which the hollow vertical columns are each elongated U-shape in form, comprising a structural unit formed by a vertical panel and vertical depending legs, having a non-structural wall extending across the ends of the legs to form a column enclosure, the column enclosure of at least one column being in communication with the interior of a transverse beam.

11. A structure according to claim 9 or 10 in which at least one of said columns defines an enclosure for building services or for storage and has access doors formed in non-structural walls thereof.

12. A structure according to claim 1 or 3 in which the beams are formed of precast prestressed concrete.

13. A ceiling structure for a building comprising a plurality of elongated inverted U-shaped beams, each formed of a top panel and a pair of legs joined along a smooth radius and defining a wide and elongated arch, said arch being shaped and finished to be pleasing to the eye, the beams being spaced laterally parallel to each other a distance apart substantially less than the transverse dimension of said arch, air ducting and lighting structures being contained within the space between said beams, upper and lower walls for said space defining an enclosure between the legs of adjacent beams for containing the air ducting and/or lighting structures whereby air and/or lighting services are provided for said building between said beams yet the major ceiling height and ceiling surfaces for the building are defined by said arches, the building being divided into at least one room, and within said room all said arches are devoid of physical interruption whereby the ceiling of said room is substantially defined by one or more of said elongated arches with clear surfaces raised substantially from the lower extremity of said legs, and in which said enclosure is further comprised of an intermediate elongated panel extending between and to the legs of the adjacent beams a predetermined distance from the lower extremity of the legs over substantially the length of the beams to define an air channel thereabove, and a lower panel extending between and to the legs of the adjacent beams generally in a plane at the lower extremity of the legs of said adjacent beams over substantially the length of the beams to define a service duct between the lower and intermediate panels.

14. A ceiling structure for a building comprising a plurality of elongated inverted U-shaped beams, each formed of a top panel and a pair of legs joined along a smooth radius and defining a wide and elongated arch, said arch being shaped and finished to be pleasing to the eye, the beams being spaced laterally parallel to each other a distance apart substantially less than the transverse dimension of said arch, air ducting and lighting structures being contained within the space between said beams, upper and lower walls for said space defining an enclosure between the legs of adjacent beams for containing the air ducting and/or lighting structures whereby air and/or lighting services are provided for said building between said beams yet the major ceiling height and ceiling surfaces for the buidling are defined by said arches, the building being divided into at least one room, and within said room all said arches are devoid of physical interruption whereby the ceiling of said room is substantially defined by one or more of said elongated arches with clear surfaces raised substantially from the lower extremity of said legs, and in which said enclosure is further comprised of an intermediate elongated panel extending between and to the legs of the adjacent beams a predetermined distance from the lower extremity of the legs over substantially the length of the beams to define an air channel thereabove, and a lower panel extending between and to the legs of the adjacent beam generally in a plane adjacent the lower extremity of the legs of said adjacent beams over substantially the length of the beams to define a service duct between the lower and intermediate panels, the lower panel being comprised of recessed lighting fixtures spaced along the beams and extending laterally between and to the legs of the adjacent beams, and spaced longitudinally by filler panels and/or air diffusers connected to the air channel.

15. A ceiling structure for a building comprising a plurality of elongated inverted U-shaped beams, each formed of a top panel and a pair of legs joined along a smooth radius and defining a wide and elongated arch, said arch being shaped and finished to be pleasing to the eye, the beams being spaced laterally parallel to each other a distance apart substantially less than the transverse dimension of said arch, air ducting and lighting structures being contained within the space between said beams, upper and lower walls for said space defining an enclosure between the legs of adjacent beams for containing the air ducting and/or lighting structures whereby air and/or lighting services are provided for said building between said beams yet the major ceiling height and ceiling surfaces for the building are defined by said arches, the building being divided into at least one room, and within said room all said arches are devoid of physical interruption whereby the ceiling of said room is substantially defined by one or more of said elongated arches with clear surfaces raised substantially from the lower extremity of said legs, and in which said enclosure is further comprised of an intermediate elongated panel extending between and to the legs of the adjacent beams a predetermined distance from the lower extremity of the legs over substantially the length of the beams to define an air channel thereabove, and a lower panel extending between and to the legs of the adjacent beams generally in a plane at the lower extremity of the legs of said adjacent beams over substantially the length of the beams to define a service duct between the lower and intermediate panels, the beams being double T in form having horizontally extending arms in the same plane as the top panel, a pair of said arms from adjacent beams abutting above the space between the beams forming said upper wall to said enclosure.

* * * * *